US008398294B2

(12) United States Patent
Troxler

(10) Patent No.: US 8,398,294 B2
(45) Date of Patent: Mar. 19, 2013

(54) DEVICE FOR DISPERSING A SOLID, LIQUID OR GASEOUS SUBSTANCE IN A LIQUID

(75) Inventor: Beat Troxler, Rain (CH)

(73) Assignee: Kinematica AG, Lucerne (CH)

( * ) Notice: Subject to any disclaimer, the term of this patent is extended or adjusted under 35 U.S.C. 154(b) by 596 days.

(21) Appl. No.: 11/793,426

(22) PCT Filed: Oct. 5, 2005

(86) PCT No.: PCT/CH2005/000579

§ 371 (c)(1),
(2), (4) Date: Nov. 30, 2007

(87) PCT Pub. No.: WO2006/066421

PCT Pub. Date: Jun. 29, 2006

(65) Prior Publication Data

US 2008/0144431 A1 Jun. 19, 2008

(30) Foreign Application Priority Data

Dec. 23, 2004 (EP) ..... 04405801

(51) Int. Cl.
*B01F 5/12* (2006.01)

(52) U.S. Cl. ..... 366/164.6; 366/264

(58) Field of Classification Search ..... 366/164.1, 366/164.6, 262–264; 418/137, 169, 236, 418/241

See application file for complete search history.

(56) References Cited

U.S. PATENT DOCUMENTS

| | | | | | |
|---|---|---|---|---|---|
| 773,953 | A | * | 11/1904 | Maginot | 415/184 |
| 1,003,020 | A | * | 9/1911 | Webb | 415/100 |
| 1,816,508 | A | * | 7/1931 | Wilsey | 418/39 |
| 2,461,276 | A | * | 2/1949 | Hetherington | 508/539 |
| 2,599,600 | A | * | 6/1952 | Arnold | 418/154 |
| 2,626,889 | A | * | 1/1953 | Carney | 208/339 |
| 3,119,339 | A | | 1/1964 | Clarke et al. | |
| 3,214,149 | A | * | 10/1965 | Budzien | 261/29 |
| 3,395,854 | A | * | 8/1968 | Martin et al. | 417/54 |
| 3,565,550 | A | * | 2/1971 | Bellmer | 417/204 |
| 3,582,235 | A | * | 6/1971 | Ito | 417/205 |
| 3,824,040 | A | * | 7/1974 | Aronson | 417/204 |
| 3,860,364 | A | * | 1/1975 | Aronson et al. | 417/204 |
| 3,929,399 | A | * | 12/1975 | Aronson | 417/54 |
| 3,932,302 | A | | 1/1976 | Eron | |
| 3,936,246 | A | | 2/1976 | Beitzel | |

(Continued)

FOREIGN PATENT DOCUMENTS

| | | |
|---|---|---|
| DE | 195 16 578 C1 | 5/1996 |
| EP | 0 043 880 A1 | 1/1982 |

(Continued)

*Primary Examiner* — David Sorkin
(74) *Attorney, Agent, or Firm* — Foley & Lardner LLP

(57) ABSTRACT

The disclosed device disperses a substance in a liquid. The device has at least one dispersing chamber, which has at least one liquid inlet, at least one substance inlet, and at least one outlet. At least one driving means is placed inside the dispersing chamber while serving to set the liquid inside the dispersing chamber in motion so that at least one cavity with varying volume forms in the liquid for drawing in the substance through the substance inlet and forcing the substance made wet with liquid through the outlet.

20 Claims, 6 Drawing Sheets

U.S. PATENT DOCUMENTS

| | | | | |
|---|---|---|---|---|
| 4,050,851 | A * | 9/1977 | Haavik | 417/68 |
| 4,422,832 | A * | 12/1983 | Haavik | 417/68 |
| 4,432,203 | A | 2/1984 | Rischer | |
| 4,453,829 | A * | 6/1984 | Althouse, III | 366/13 |
| 4,460,276 | A * | 7/1984 | Arribau et al. | 366/13 |
| 4,850,704 | A * | 7/1989 | Zimmerly et al. | 366/263 |
| 4,915,509 | A * | 4/1990 | Sauer et al. | 366/171.1 |
| 5,122,035 | A * | 6/1992 | Juhola | 417/68 |
| 5,203,515 | A | 4/1993 | Stoerzbach | |
| 5,540,499 | A | 7/1996 | Seeger | |
| 5,575,559 | A | 11/1996 | Roll | |
| 5,577,497 | A | 11/1996 | Mecikalski et al. | |
| 5,827,909 | A | 10/1998 | DesMarais | |
| 6,030,191 | A * | 2/2000 | Wood et al. | 418/1 |
| 6,391,082 | B1 | 5/2002 | Holl | |
| 6,616,325 | B1 | 9/2003 | Brown | |
| 7,014,439 | B2 * | 3/2006 | Kano et al. | 418/259 |
| 2002/0089074 | A1 | 7/2002 | Holl | |
| 2003/0202421 | A1 * | 10/2003 | Ding | 366/264 |
| 2004/0028547 | A1 * | 2/2004 | Wilk et al. | 418/259 |
| 2004/0253135 | A1 * | 12/2004 | Bohr | 418/259 |
| 2006/0233653 | A1 * | 10/2006 | Trapalis | 418/54 |

FOREIGN PATENT DOCUMENTS

| | | | |
|---|---|---|---|
| EP | 0 436 462 | B1 | 1/1994 |
| EP | 0 587 714 | B1 | 4/1995 |
| EP | 0 648 537 | | 4/1995 |
| EP | 0 802 823 | B1 | 10/1997 |
| JP | 50-20018 | | 6/1975 |
| JP | 51-060066 | | 5/1976 |
| JP | 57-18488 | | 1/1982 |
| JP | 57-131805 | | 8/1982 |
| JP | 58-177128 | | 10/1983 |
| JP | 62-062831 | | 4/1987 |
| JP | 2-95536 | | 7/1990 |
| JP | 8-502423 | | 3/1996 |
| JP | 9-271654 | | 10/1997 |
| JP | 10-512187 | | 11/1998 |
| JP | 2002-029884 | | 1/2002 |
| JP | 2003-521566 | | 7/2003 |
| SU | 606609 | | 4/1978 |

* cited by examiner

DEVICE FOR DISPERSING A SOLID, LIQUID OR GASEOUS SUBSTANCE IN A LIQUID

The present application is a National Phase Application of PCT/CH2005/000579 filed on Oct. 5, 2005, which claims priority to European Patent Application 04405801.4 filed on Dec. 23, 2004, both aforementioned applications being incorporated herein by reference in their entireties.

BACKGROUND

The present invention relates to a device for dispersing a substance in a liquid.

Devices of this type serve to form a dispersion by finely distributing the substance in a liquid. The substance can be present as a solid, liquid or gaseous phase or also as a mixture of different phases. Wetting and homogeneously distributing the substance during the mixing process is often problematic. If the substance is a powder, there is also the risk of dust comprising unwetted powder undesirably forming in the environment.

It is known to supply liquid and substance to a dispersing chamber and to work them intensively by means of a dispersing tool in order to achieve fine distribution of the substance (see e.g. patent specifications EP-B1-436 462 and EP-B1-648 537 by the same applicant or patent specification EP-B1-587 714). However, it has been shown that wetting the substance with liquid is problematic and can result in undesired inhomogeneities in the dispersion. If, for example, a powdered substance is supplied, lumps can form in the mixing zone, i.e. the zone in which the substance comes into contact with the liquid, and these lumps clog the substance supply line or impede homogeneous distribution of the substance in the liquid. The known dispersing devices also have the disadvantage that the suction capacity is dependent upon the liquid throughput and the pressure at the outlet, with the result that the suction capacity may be too low to be able to suck in and wet a sufficient quantity of the substance to be dispersed.

Devices for producing a dispersion of gas and liquid are known from patent specifications U.S. Pat. No. 3,119,339 and U.S. Pat. No. 3,932,302. These devices comprise an eccentrically arranged gearwheel with internal teeth which mesh with a pinion, and a crescent-shaped insert. Devices of this type have inter alia the disadvantage that they are unsuitable for the dispersal of powdered substances. As the latter are virtually incompressible, the meshing of the internal teeth with the pinion would generate forces so great that the device would be damaged, e.g. the walls of the teeth or the pinion or possibly the bearings would be damaged. It is also disadvantageous that the throughput and therefore the dispersion volume producible per unit time are relatively low.

Devices which have radially displaceable vanes for producing a variable working volume are known from patent specifications U.S. Pat. No. 3,936,246 and U.S. Pat. No. 6,616,325 B1. This has the disadvantage that narrow gaps are formed, which can cause accumulation of the substance to be dispersed. Especially if the substance is a powder, this accumulation can lead to the vanes jamming in the guides and, ultimately, to failure of the device.

A device which has a cylinder rotating in a tube for the production of an emulsion is known from patent application US-A1-2002/0089074. The device has inter alia the disadvantage that it is poorly suited to the dispersal of powdered substances because pumping means of complex design have to be provided for the introduction of these substances.

Starting from this prior art, an object of the present invention is to propose a device which allows a substance to be sucked in and distributed in a liquid as homogeneously as possible in a simplified and improved manner.

SUMMARY

A device which achieves this object is set out in claim 1. Preferred developments are set out in the remaining claims.

BRIEF DESCRIPTION OF THE DRAWINGS

The invention will be described hereinbelow with the aid of preferred embodiments and with reference to drawings, wherein.

Figure 1:
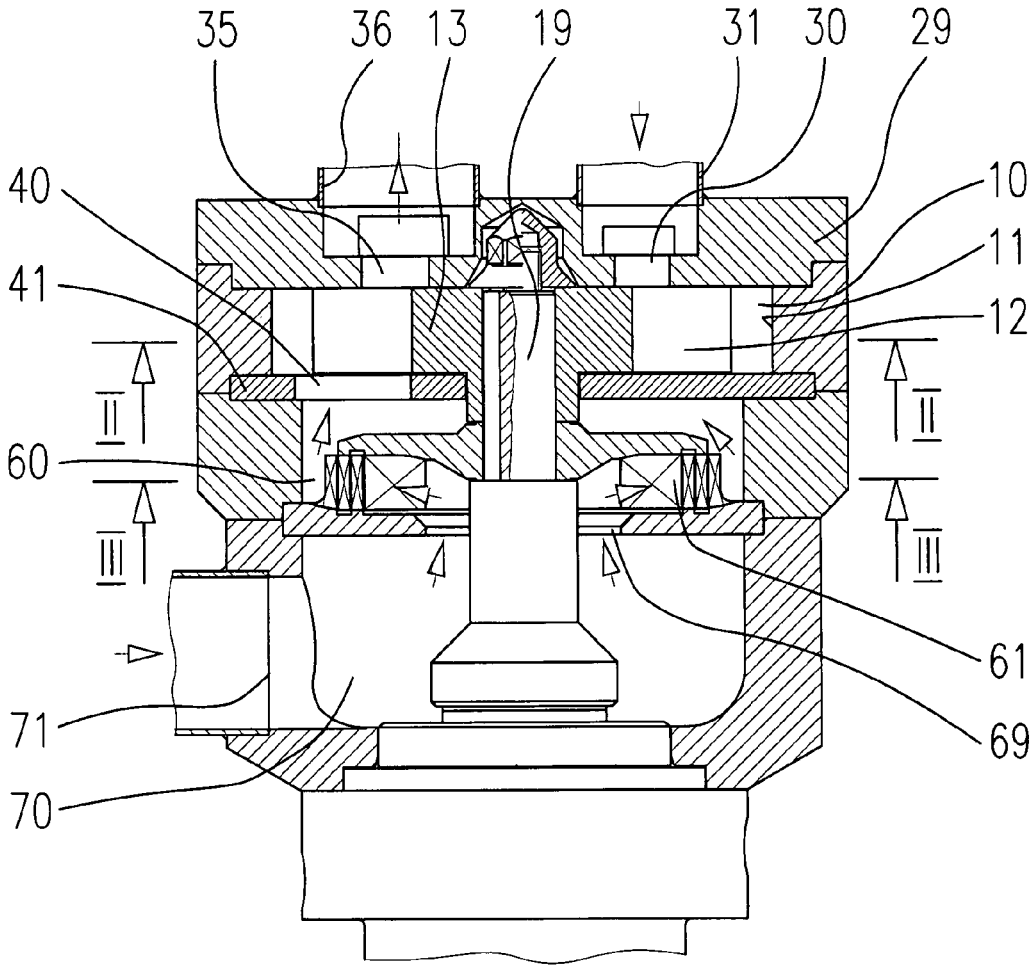
FIG. 1 shows a part-sectional side view of the device according to the invention.
Figure 2:
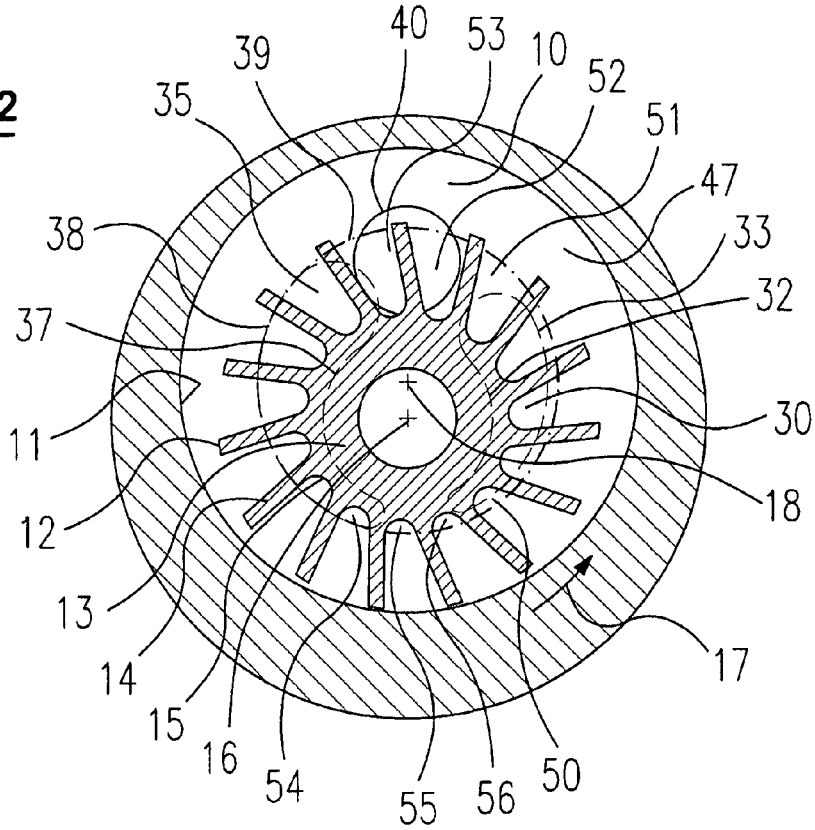
FIG. 2 shows the device according to FIG. 1 in the section plane II-II.

As can be seen from FIGS. 1 and 2, the dispersing device comprises a dispersing chamber 10 which is preferably bounded laterally by a cylindrical wall 11. The dispersing chamber 10 contains a driving means 12, by means of which liquid can be set into motion.

DETAILED DESCRIPTION

The driving means is preferably formed as an impeller 12. The latter comprises a hub 13 which is rotatable about the rotation axis 16 and on which a plurality of vanes 14 is mounted. The impeller 12 is eccentrically arranged in the dispersing chamber 10 so that the rotation axis 16 lies adjacent to the centre 18 of the dispersing chamber 10. Owing to this arrangement, the distance between the base 15 of a vane 14 and the wall 11 of the dispersing chamber 10 changes recurrently between a minimum value and a maximum value during rotation of the impeller 12. The axis passing through the points 16 and 18 extends substantially in the neutral region, where neither the suction effect generated in the dispersing chamber 10 nor the pumping effect predominates.

The impeller 12 is fixed to a shaft 19 which can be set into rotation by means of a drive (not shown). In the embodiment shown in FIG. 1, the shaft 19 is arranged vertically. It is also possible to place the dispersing device in a different position, for example so that the shaft 19 is arranged horizontally.

The dispersing chamber 10 is provided at the top with a cover 29 which contains a substance inlet 30 for introducing a substance into the dispersing chamber 10 and an outlet 35 for discharging the product from the dispersing chamber 10. The substance inlet 30 and the outlet 35 are each connected to a feed line 31 and 36 respectively. If, as mentioned hereinabove, the shaft 19 is arranged horizontally, it is advantageous to dispose the substance inlet 30 at a higher level than the outlet 35.

As can be seen from FIG. 2, the substance inlet 30 and the outlet 35 are substantially sickle-shaped so that the distance between the edges 32 and 33 of the substance inlet 30 increases in the direction of rotation 17 and the distance between the edges 37 and 38 of the outlet 35 decreases in the direction of rotation 17. The inner edge 32 of the substance inlet 30 and the inner edge 37 of the outlet 35 lie approximately on a circle, the centre of which lies on the rotation axis 16 of the impeller 12. The outer edge 38 of the outlet 35 lies on a circle 39 located substantially concentrically with the wall 11 of the dispersing chamber 10. The outer edge 33 of the substance inlet 30 is likewise formed in a substantially circular manner and is arranged so that it lies within the circle 39. During operations this arrangement counteracts the risk of liquid ingressing from the dispersing chamber 10 into the substance inlet 30 and the risk of the supplied substance forming lumps.

If the feed line 31 leading to the substance inlet 30 has a cylindrical shape, the transition of the feedline 31 to the sickle shape of the substance inlet 30 can, if necessary, be optimised so that liquid cannot spray into the substance inlet 30 from the dispersing chamber 10, even if turbulence is high. For this purpose, the transition is not abrupt in cross-section, but e.g. in the form of a ramp so that, when seen in the flow direction, the middle part of the substance inlet lies higher than its two ends.

As FIG. 1 also shows, the bottom of the dispersing chamber 10 contains a disc 41 with a liquid inlet 40 for the introduction of liquid into the dispersing chamber 10. As can be seen from FIG. 2, the liquid inlet 40 is substantially arranged between the substance inlet 30 and the outlet 35, wherein the substance inlet 30 is arranged upstream of the liquid inlet 40 and the latter is arranged upstream of the outlet 35 when seen in the direction of rotation 17. In the example shown in FIG. 2, the liquid inlet 40 has a substantially circular shape. For the sake of greater clarity, in FIG. 1 the position of the liquid inlet 40 is shown rotated through 90 degrees in relation to the position shown in FIG. 2.

The disc 41 is preferably rotatably arranged so that the position of the liquid inlet 40 is variable in relation to the neutral axis passing through the points 16 and 18. The dispersing device also comprises pumping means 61 for conveying liquid through the liquid inlet 40 into the dispersing chamber 10.

The dispersing device described thus far functions as follows:

The impeller 12 is set into rotation in the direction 17 indicated in FIG. 2 and liquid is pumped through the liquid inlet 40 into the dispersing chamber 10 by the pumping means 61. The liquid is also set into rotation by the rotating impeller 12 and is driven outwards by the centrifugal force so that it is lifted from the hub 13 and forms a rotating liquid ring 47 which is substantially concentric with the wall 11 of the dispersing chamber 10. In FIG. 2, the transition between the ring 47 of rotating liquid and the liquid-reduced inner region is indicated by a dot-dash line 39. The position of this transition 39 and therefore the thickness of the liquid ring 47 is substantially determined by the position of the outer edge 38 of the outlet 35 because—as explained hereinbelow—liquid located in the inner region is conveyed through the outlet 35 by the pumping effect.

Between the base 15 of adjacent vanes 14 and the liquid ring 47 is formed a respective cavity 50-57, the volume of which is recurrently increased and decreased by the rotation of the impeller 12, there by generating a pumping effect. If, for example, the cavity provided with the reference numeral 50 in FIG. 2 is taken as a starting point, first of all its volume increases when it moves towards the position of the cavity 51. This volume increase produces a decrease in pressure, which has the effect that substance is sucked through the substance inlet 30 into the dispersing chamber 10 and, lastly, wetted and mixed with the liquid. The generated suction effect ensures that the substance does not come into contact with the liquid while still in the substance inlet 30 and does not clog the substance inlet 30 by forming lumps.

The cavity 50 then passes through the region of the cavities designated by the reference numerals 52 and 53 in FIG. 2, where its volume barely changes, so that neither a suction effect nor a pumping effect is generated. The liquid inlet 40 is arranged in this neutral zone. The cavity 50 subsequently moves towards the position of the cavity 54 so that its volume is reduced again and the product consisting of liquid and substance contained therein is expelled through the outlet 35. The cavity 50 then passes through a further neutral zone between the pressure side and the suction side in the region of the cavities 55 and 56.

The dispersing chamber 10 is designed so that the flow conditions are usually turbulent and fine distribution of the substance in the liquid is favoured.

The mixing ratio of substance and liquid can be adjusted by rotating the disc 41. The position of the liquid inlet 40 is thus displaced either more towards the pressure side or more towards the suction side so that the amount of liquid flowing into the dispersing chamber 10 per unit time is regulated accordingly.

By rotation of the driving means 12, the substance in the dispersing chamber 10 is intensively wetted. Consequently, the risk of lumps forming is virtually eliminated, especially in the case of powdered substances. This is also effectively avoided by the fact that the dispersing chamber 10 can be designed so as to be free of narrow apertures or other narrow gaps. In particular, the vanes 14 do not need to be radially displaceably arranged, but can be fixedly connected to the hub 13. Furthermore, a high vacuum with a simultaneous high suction capacity is generated during operation and this is substantially independent of the liquid throughput and, to a certain extent, also independent of the pressure at the outlet 35. In this way, dust-free incorporation into the liquid is ensured, especially in the case of powdered substances. It has been shown that the generatable suction capacity is sufficiently high that heavy powders, e.g. metal-containing powders, can also be sucked in.

The cavities produced are liquid-reduced regions which inter alia are bounded by the liquid itself (cf. the dot-dash line 39 in FIG. 2). Therefore, there is no occurrence of sealing or lubrication problems such as those which arise in the known dispersing devices in which, in order to produce a variable working volume, a gearwheel meshes with a pinion.

The suction and pumping effect of the dispersing device described here is produced in much the same way as in water-ring pumps. Unlike these pumps, however, the dispersing device used here has the function of sucking in, wetting and dispersing a substance in the liquid in an optimum manner. For this purpose, the dispersing device has a liquid inlet 40 so that the liquid in the ring is continually replaced during operation. In contrast, water-ring pumps contain water as a working fluid, which remains permanently in the working chamber.

In a first development of the dispersing device, the outlet 35 is fluidly connected to the liquid inlet 40. This allows the liquid to be conducted repeatedly through the dispersing chamber 10. By means of this recirculation, it is possible e.g.

to provide a gradual increase in the concentration of substance in the liquid and/or to obtain a particularly homogeneous distribution of the substance in the liquid. In the latter case, the substance inlet 30 is advantageously closed, e.g. by means of a valve, and the dispersion is conducted repeatedly through the dispersing chamber 10.

In a second development of the dispersing device, which is also shown in FIG. 1, a second dispersing chamber 60 is provided. This is fluidly connected via the liquid inlet 40 to the first dispersing chamber 10 and, as shown in FIG. 1, is located underneath the latter. In the second dispersing chamber 60 is arranged at least one dispersing tool 61 which serves as a pumping means and as a working means for distributing the substance particularly finely in the liquid.

Figure 3:
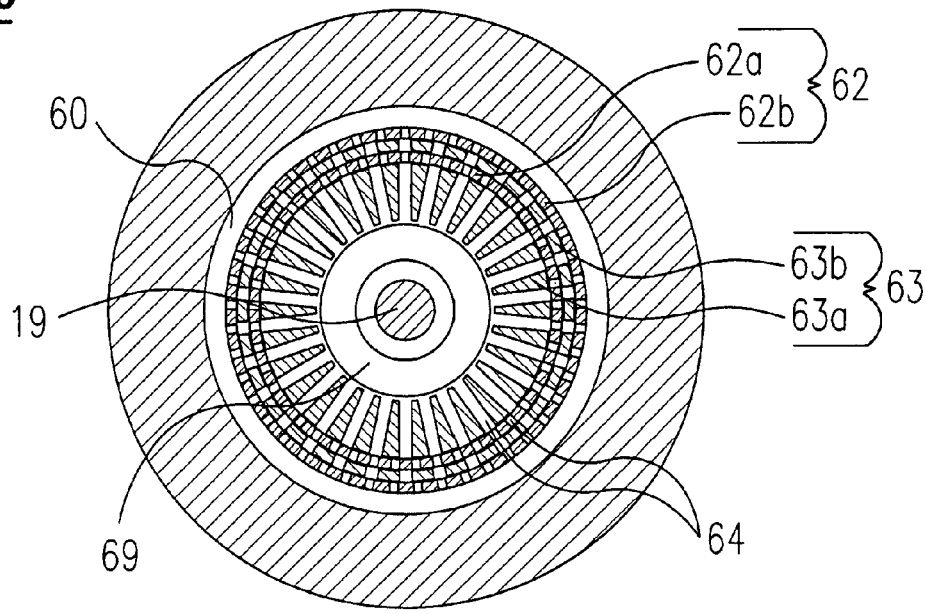
FIG. 3 shows the device according to FIG. 1 in the section plane III-III.

FIG. 3 shows an example of a dispersing tool 61 with two toothed rings 62*a* and 62*b* which form the rotor 62, and two toothed rings 63*a* and 63*b* which form the stator 63. The toothed rings 62*a*, 62*b*, 63*a*, 63*b* have slots 64, through which liquid and substance contained therein can pass. The number and formation of the toothed rings 62*a*, 62*b*, 63*a*, 63*b* are selected according to the intended application. The inner region of the dispersing tool 61 is provided with a passage 69 which is fluidly connected to a supply chamber 70. As shown in FIG. 1, this supply chamber 70 is located underneath the dispersing tool 61 and comprises an inlet 71. If the dispersion is to be recirculated; the outlet 35 of the first dispersing chamber 10 is connected to the inlet 71.

When the dispersing device is set into operation, liquid is first sucked out of the supply chamber 70 by means of the dispersing tool 61 and pumped via the liquid inlet 40 into the first dispersing chamber 10, in which—as already described hereinabove—a liquid ring is formed. Substance is sucked in through the substance inlet 30 and dispersed in the liquid. The resulting dispersion is conducted back into the supply chamber 70 via the outlet 35 and the inlet 71. On passing through the slots 64, the liquid and the substance contained therein are accordingly worked by the rotor 62 and the stator 63 to produce improved and homogenised distribution of the substance. The liquid circulates repeatedly between the first and second dispersing chamber 10, 60 until the desired substance concentration has been reached and/or until a sufficiently homogeneous dispersion has been obtained.

The provision of two dispersing chambers 10 and 60 has the advantage that the processes of wetting the substance with liquid and working with the dispersing tool 61 are carried out in separate chambers and, therefore, the two processes do not affect one another. In this way, particularly homogeneous dispersions can be produced without the problems of lump formation and/or undesired dust formation in the case of powdered substances.

Figure 4:
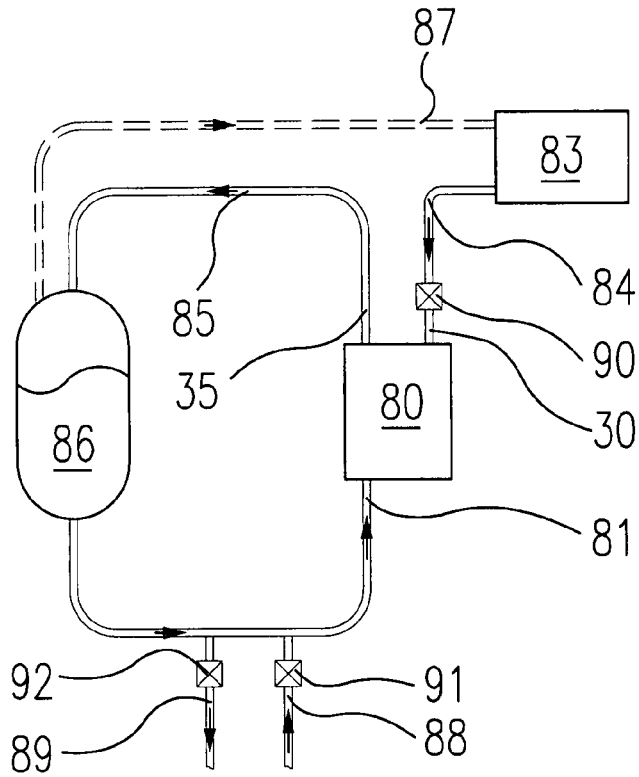
FIG. 4 shows a hydraulic diagram of the device according to the invention.

FIG. 4 shows a third development of the dispersing device in schematic form. The rectangle with the reference numeral 80 schematically represents the dispersing unit comprising the first dispersing chamber 10 and the driving means 12 and—if provided—the second dispersing chamber 60 and the dispersing tool 61. Accordingly, the reference numeral 81 designates the liquid inlet 40 if a second dispersing chamber 60 is not provided or the inlet 71 if it is provided. The supply container 83 holding the substance to be dispersed is connected by a line 84 to the substance inlet 30. A container 86, which serves to separate gas and/or non-dispersed substance, is arranged in the recirculation line 85 connecting the outlet 35 of the dispersing unit 80 to the inlet 81. A return line 87, which connects the separating container 86 to the supply container 83 in order to feed back the separated gas or the separated substance, can optionally be provided, as indicated by the broken lines in FIG. 4. A supply line 88 connected to the inlet 81 serves to supply the liquid. A discharge line 89, which joins the recirculation line 85, serves to discharge the dispersion produced from liquid and substance. The lines 84, 88 and 89 are provided in a known manner with valves 90, 91 and 92 in order to be able to open and close the respective passage.

If a dispersing tool 61 is provided, measures have to be taken so that as little air as possible is contained in the liquid to be worked. Too large a proportion of air can result in no more liquid being conveyed through the slots 64 in the toothed rings and, consequently, operation being interrupted. If, in addition to the substance, the liquid leaving the outlet 35 also contains ambient air, the latter can be separated in the separating container 86 and reliable operation of the dispersing tool 61 can be ensured.

It is also possible to form the dispersing device as a closed system so that gas exchange with the environment is prevented. In this case, the supply container 83 and the separating container 86 have a closed formation.

The use of a closed system is advantageous e.g. when the substance to be dispersed is a very fine powder and undesired powder deposits in the environment are to be avoided. If the powder is difficult to disperse and/or very fine, the air in the separating container 86 may still contain non-dispersed powder. This can be fed back to the supply container via the return line 87.

The use of a closed system is also advantageous when the dispersal of powdered substance entails the risk of dust explosions. In this case, the air in the dispersing device, in particular in the supply container 83 and the separating container 86, is replaced by an inert gas, for example nitrogen. During operation, the inert gas is separated in the separating container 86 and fed back to the supply container 83 via the return line 87.

Figure 5:
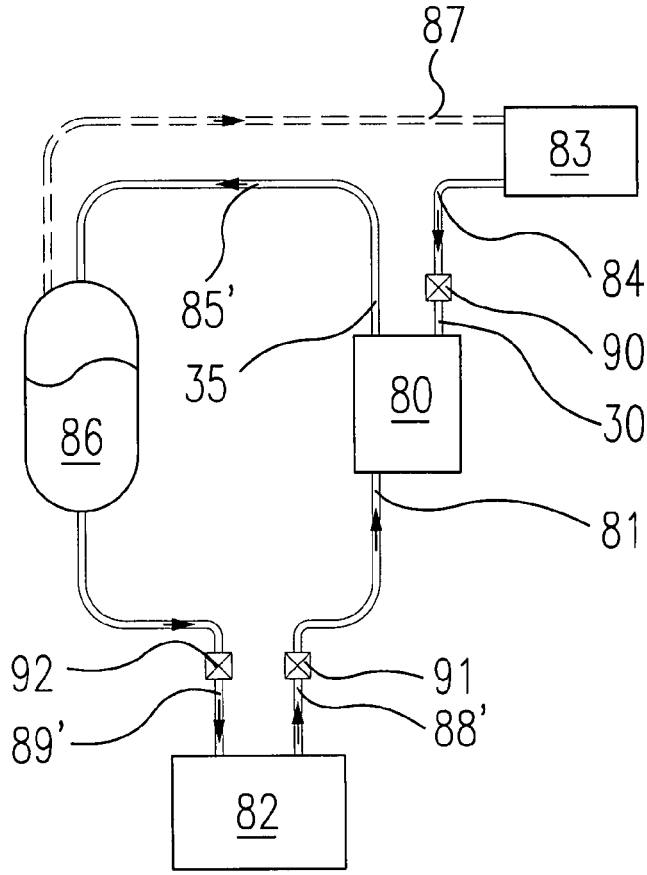
FIG. 5 shows another variant of a hydraulic diagram of the device according to the invention.

FIG. 5 shows a variant of the dispersing device for batch operation. In FIGS. 4 and 5, like parts are provided with like reference numerals. The rectangle with the reference numeral 82 schematically represents a container in which the liquid is held. If the separation of gas and/or non-dispersed substance is not necessary, the separating container 86 can also be omitted.

To incorporate the substance into the liquid, the container is connected to the inlet 81 via the line 88' and to the outlet 35 via the lines 89' and 85'. The liquid is conducted repeatedly through the dispersing unit 80, in which the substance from the supply container 83 is added, and through the container 82 until the desired substance concentration and homogeneity has been reached. Lastly, the dispersion thus produced is collected in the container 82, and the latter is separated from the dispersing unit 80. Defined batches of dispersions can thus be produced in a simple manner.

Depending upon the intended application, recirculation of the liquid or the dispersion through the dispersing unit 80 is not absolutely necessary. The dispersing unit 80 can e.g. be arranged in a processing line in which liquid is continuously fed through the inlet 81 and substance is continuously fed through the inlet 30 into the dispersing unit 80 and liquid and substance are mixed together, and the resulting dispersion is supplied for further processing via the outlet 35.

Figure 6:
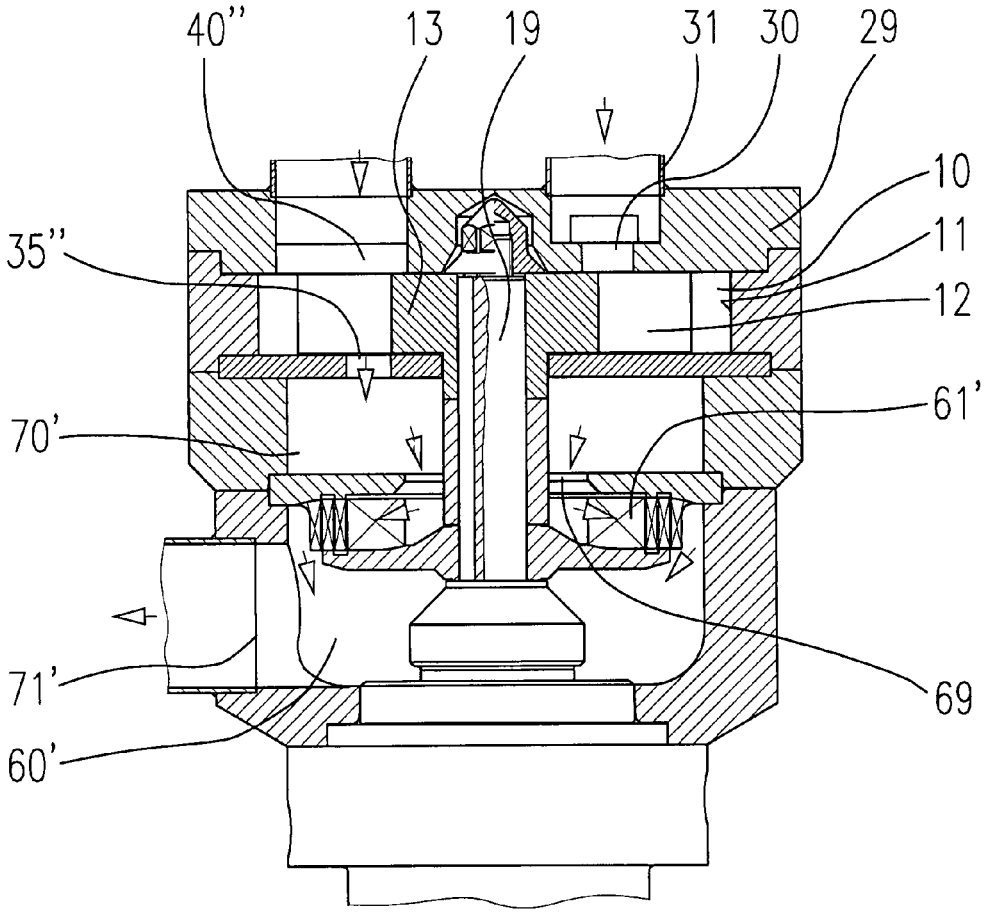
FIG. 6 shows a part-sectional side view of a further embodiment of the device according to the invention.

FIG. 6 shows a further embodiment of the dispersing device, which essentially differs from the embodiment shown in FIG. 1 in that the liquid inlet 40" and the outlet 35" have been interchanged and in that the dispersing tool 61' is arranged so that a pumping effect is producible from the outlet 35" to the outlet 71'.

The liquid inlet 40" is disposed in the cover 29 and is located in the neutral zone or on the pressure side, i.e. in the region of the neutral axis extending through the points 16 and 18 shown in FIG. 2 or to the left thereof. The liquid inlet 40" can also be arranged in the wall 11 of the dispersing chamber 10 so that it opens laterally into the dispersing chamber 10.

The outlet 35" is an internal opening located between the first dispersing chamber 10 and the chamber 70'. Its shape and radial position are selected as shown in FIG. 2 for the outlet 35 in the first embodiment.

During operation, liquid is conducted through the liquid inlet 40" into the dispersing chamber 10, where a liquid ring and the cavities are formed so that substance is sucked in through the substance inlet 30 and dispersed in the liquid. The dispersion is pumped via the outlet 35" and the chamber 70' into the second dispersing chamber 60', where it is worked by the dispersing tool 61' and, lastly, discharged via the outlet 71'. Fine dispersal in the second dispersing chamber 60' therefore takes place after wetting in the first dispersing chamber 10 so that the dispersion is producible in a single pass.

Figure 7:
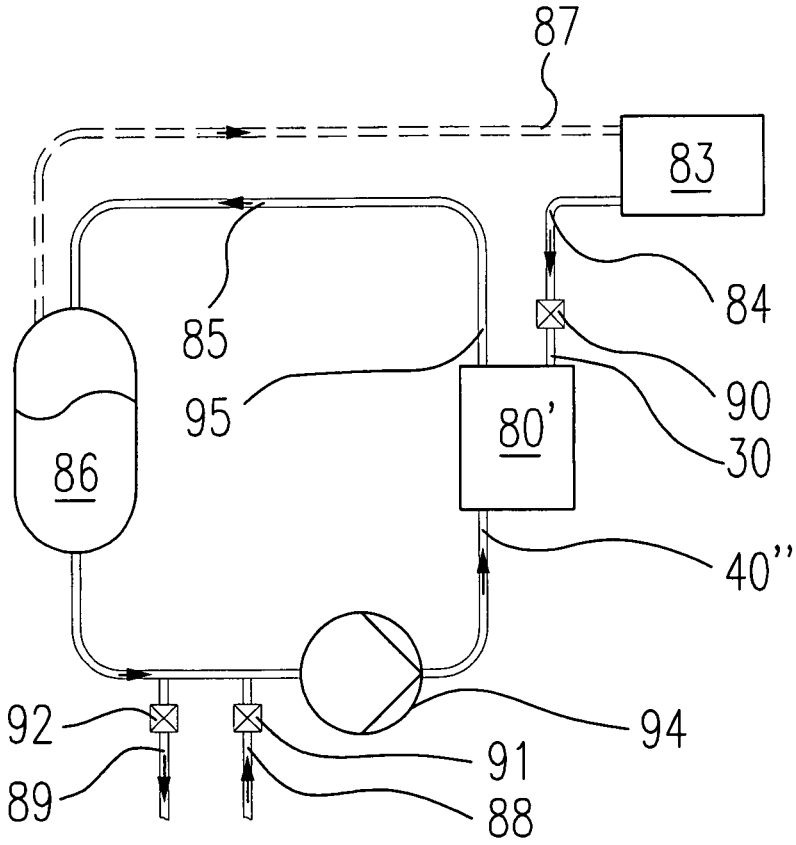
FIG. 7 shows a hydraulic diagram of the device according to FIG. 6.

However, where expedient, recirculation can also be provided, as shown in FIG. 7. To enable liquid to pass through the liquid inlet 40" into the dispersing chamber 10, pumping means 94 are necessary, for example in the form of a feed pump or by providing different liquid levels in order to generate a pressure difference. The reference numeral 80' schematically represents the dispersing unit comprising the first dispersing chamber 10 and the driving means 12 and—if provided—the second dispersing chamber 60' and the dispersing tool 61'. The reference numeral 95 designates the outlet 35" if a second dispersing chamber 60' is not provided or the outlet 71' if it is provided. The other reference numerals have the same meaning as in the diagram according to FIG. 4.

Figure 8:
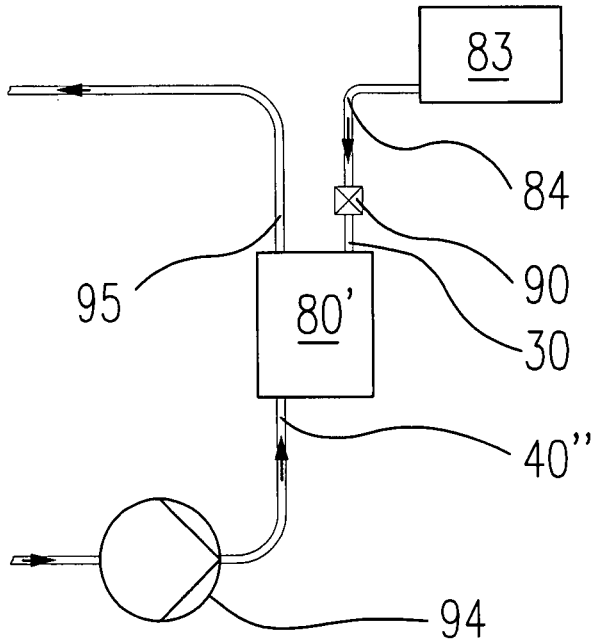
FIG. 8 shows another variant of a hydraulic diagram of the device according to FIG. 6.

If the dispersion is produced in a single pass, an arrangement as shown in the hydraulic diagram according to FIG. 8 is sufficient.

The dispersing device according to the invention can be used in diverse ways for dispersing a substance in a liquid. The substance can be present as a solid, liquid or gaseous phase or as a mixture of different phases. The dispersing device according to the invention is especially suitable for the dispersal of free-flowing solid substances, e.g. powders, dyestuffs, fillers, substances from the foodstuffs industry and/or insoluble substances generally, e.g. poorly wettable powder such as metallic powder.

Figure 9:
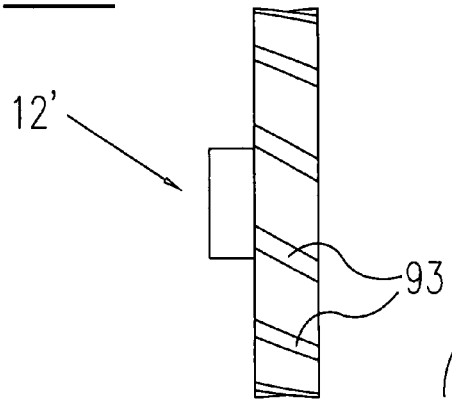
FIG. 9 shows a side view of a further embodiment of the driving means for the device according to the invention.
Figure 10:
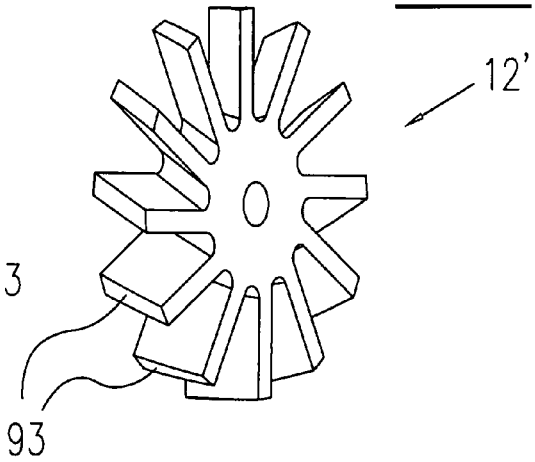
FIG. 10 shows a perspective view of the driving means according to FIG. 9.

Starting from the above description, numerous modifications are available to the person skilled in the art without departing from the scope of the invention as defined by the claims. For example, the following modifications or broadenings are possible:

The formation of the impeller is adapted to the flow to be generated in the dispersing chamber. FIGS. 9 and 10 show a variant of the impeller 12' in which the vanes 93 are arranged obliquely to the rotation axis. This arrangement permits the generation of particularly turbulent flows in the dispersing chamber 10 and thereby favours mixing of the substance in the liquid.

Figure 11:
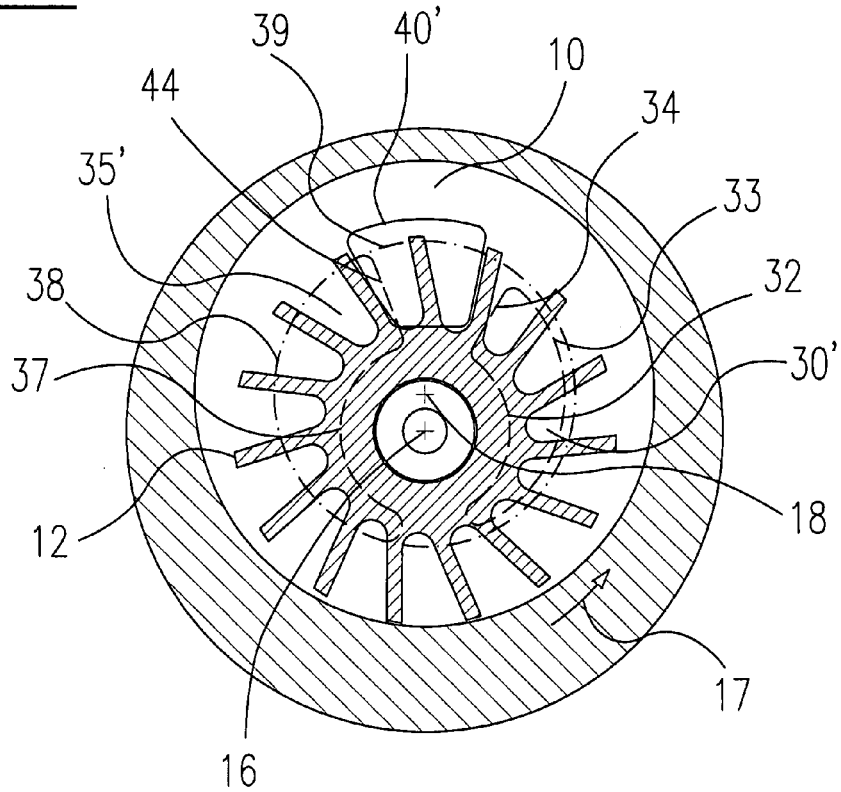
FIG. 11 shows another variant of the openings 30', 35' and 40' in the device according to FIG. 1 in the section plane II-II.

The shape of the openings 30, 35 and 40 does not need to be as precise as shown in FIG. 2. FIG. 11 shows a variant in which the substance inlet 30' and the outlet 35' are sickle-shaped, wherein the respective front edge 34, 44 is substantially straight. The liquid inlet 40' is substantially square.

It is also possible to provide a plurality of substance inlets 30, 30', outlets 35, 35', 35", and/or liquid inlets 40, 40', 40", which are arranged in a suitable manner in the zones of increased pressure or decreased pressure or in the neutral zone.

Instead of an eccentric arrangement of the impeller 12, 12', it is also possible to form the wall 11 elliptically and to arrange the impeller 12, 12' in the middle. This formation of the dispersing chamber 10 results in four neutral zones, in which neither a suction effect nor a pumping effect is produced, and two zones each of increased pressure and decreased pressure.

The wall 11 of the dispersing chamber 10 can be roughened and/or be provided with additional obstacles in the form of depressions and/or projecting elements. In this way, a turbulent flow can also be generated in the vicinity of the wall 11, thereby favouring liquid exchange within the liquid ring 47. This is especially advantageous in the case of heavy substances because increased concentration in the outer region of the liquid ring 47 is avoided.

According to requirements, it can be necessary to use a plurality of dispersing tools instead of one dispersing tool 61, 61' in order to be able to work the liquid and the substance contained therein in a suitable manner.

The invention claimed is:

1. A device configured to disperse a substance in a liquid, comprising:

at least one dispersing chamber comprising:

at least one liquid inlet configured to introduce liquid into the inside of the at least one dispersing chamber, at least one substance inlet configured to introduce substance into the inside of the at least one dispersing chamber, at least one outlet configured to discharge the substance wetted with the liquid out of the inside of the at least one dispersing chamber, and a peripheral wall that is arranged stationary; and at least one rotatable impeller which is arranged in the at least one dispersing chamber and includes vanes, each of which extends from a base, the at least one rotatable impeller being configured to, during rotation, accumulate the liquid fed into the at least one dispersing chamber and set the liquid into motion in the at least one dispersing chamber in the form of a liquid ring within which is formed a plurality of cavities of varying respective volumes each limited by the liquid ring, wherein the rotatable impeller and the at least one dispersing chamber are configured so that, when the rotatable impeller is in rotation, the distance between the base of each vane of the rotatable impeller and the peripheral wall of the at least one dispersing chamber changes recurrently in order to vary the volume of each cavity; and wherein the at least one substance inlet and the outlet are configured such that the rotation of the at least one rotatable impeller causes the substance to be sucked in through the at least one substance inlet into the inside of the at least one dispersing chamber and to be expelled together with liquid from the liquid ring through the at least one outlet after the substance has been wetted with the liquid of the liquid ring.

2. The device according to claim 1, further comprising:

a second dispersing chamber fluidly connected to the at least one liquid inlet, the at least one outlet, or a combination thereof; and at least one dispersing tool, the at least one dispersing tool being arranged in the second dispersing chamber.

3. The device according to claim 2, wherein the at least one dispersing tool comprises a rotor and a stator.

4. The device according to claim 2, wherein the at least one dispersing tool is arranged on a shaft and the at least one impeller is also arranged on the same shaft.

5. The device according to claim 1, wherein the rotatable impeller is eccentrically arranged in the at least one dispersing chamber.

6. The device according to claim 1, wherein the rotatable impeller comprises vanes which seen transversally to the rotation axis of the rotatable impeller are arranged obliquely to the rotation axis of the rotatable impeller.

7. The device according to claim 1, wherein the at least one outlet, the at least one substance inlet, or a combination thereof is seen in flow-direction of the substance through the outlet or the substance inlet, respectively, substantially sickle-shaped.

8. The device according to claim 1, further comprising a pumping means for pumping liquid through the at least one liquid inlet into the at least one dispersing chamber.

9. The device according to claim 1, further comprising a container for separating gas, the substance not dispersed in the liquid, or a combination thereof, the container having a container inlet and a container outlet, the at least one outlet of the at least one dispersing chamber being connected to the container inlet.

10. The device according to claim 1, wherein the at least one dispersing chamber further comprises a cover wall in which the at least one liquid inlet is formed, the cover wall being variably arranged in relation to the peripheral wall for adjusting a mixing ratio of the substance and the liquid.

11. The device according to claim 1, wherein the at least one outlet comprises an outer edge lying substantially on a circle and extending over an arc length which is less than the half of the arc length of the circle.

12. The device according to claim 1, wherein the rotatable impeller comprises vanes which are rigidly connected to a shaft.

13. The device according to claim 1, wherein, seen in the rotational direction of the rotatable impeller, the at least one substance inlet is arranged permanently upstream of the at least one liquid inlet and the at least one outlet is arranged permanently downstream of the at least one liquid inlet.

14. The device according to claim 1, wherein, the peripheral wall of the at least one dispersing chamber is substantially circular or elliptical in shape.

15. The device according to claim 1, wherein the at least one dispersing chamber further comprises a cover wall in which the at least one substance inlet and one of the at least one liquid inlet and the at least one outlet are formed.

16. The device according to claim 1, wherein the vanes of the impeller extend freely from the base so that the space between the vanes is open at the top and at the bottom.

17. The device according to claim 1, wherein at least one of the substance inlet, liquid inlet and outlet is arranged adjacent to the impeller.

18. The device according to claim 1, wherein the at least one dispersing chamber comprises at least N1 liquid inlets, at least N2 substance inlets and at least N3 outlets, wherein at least of N1, N2 and N3 is equal to 2.

19. The device according to claim 8, wherein the pumping means comprises at least one of a generator for generating different liquid levels, a dispersing tool and a feed pump.

20. The device according to claim 8, wherein the pumping means is arranged outside the at least one dispersing chamber.

* * * * *

UNITED STATES PATENT AND TRADEMARK OFFICE

CERTIFICATE OF CORRECTION

PATENT NO. : 8,398,294 B2
APPLICATION NO. : 11/793426
DATED : March 19, 2013
INVENTOR(S) : Troxler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 880 days.

Signed and Sealed this
Eleventh Day of November, 2014

Michelle K. Lee

Michelle K. Lee
*Deputy Director of the United States Patent and Trademark Office*